US008636332B2

(12) United States Patent
Saita

(10) Patent No.: US 8,636,332 B2
(45) Date of Patent: Jan. 28, 2014

(54) IMAGE RECORDING APPARATUS AND METHOD OF ADJUSTING RECORDING HEAD IN IMAGE RECORDING APPARATUS

(75) Inventor: Hirofumi Saita, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 341 days.

(21) Appl. No.: 13/033,243

(22) Filed: Feb. 23, 2011

(65) Prior Publication Data

US 2011/0205281 A1 Aug. 25, 2011

(30) Foreign Application Priority Data

Feb. 24, 2010 (JP) ..... 2010-039054

(51) Int. Cl.
*B41J 29/38* (2006.01)

(52) U.S. Cl.
USPC ..... 347/16; 347/101; 347/104

(58) Field of Classification Search
USPC ..... 347/7, 14, 45, 103, 104, 16, 19, 101; 198/401; 318/608; 399/82; 382/294
See application file for complete search history.

(56) References Cited

U.S. PATENT DOCUMENTS

| | | | | |
|---|---|---|---|---|
| 4,851,752 | A * | 7/1989 | Nishimura et al. | 318/602 |
| 2003/0024792 | A1* | 2/2003 | Yoshida et al. | 198/401 |
| 2004/0109703 | A1* | 6/2004 | Koike | 399/82 |
| 2005/0128231 | A1* | 6/2005 | Talon et al. | 347/7 |
| 2006/0055719 | A1 | 3/2006 | Furuya et al. | |
| 2006/0215008 | A1* | 9/2006 | Kibayashi | 347/104 |
| 2007/0086679 | A1* | 4/2007 | Kudo et al. | 382/294 |
| 2007/0263022 | A1* | 11/2007 | Chigusa | 347/14 |
| 2008/0043082 | A1* | 2/2008 | Yahiro | 347/103 |
| 2008/0186356 | A1* | 8/2008 | Takahashi | 347/45 |
| 2009/0267977 | A1 | 10/2009 | Sumi | |

FOREIGN PATENT DOCUMENTS

| | | | |
|---|---|---|---|
| JP | 58-104917 | | 7/1983 |
| JP | 7-323582 | A | 12/1995 |
| JP | 2006-76266 | A | 3/2006 |
| JP | 2007-98838 | A | 4/2007 |
| JP | 2009-241282 | A | 10/2009 |

OTHER PUBLICATIONS

Japanese Office Action issued Jun. 13, 2013 for related Japanese Patent Application No. 2010-039054 with English translation.

* cited by examiner

*Primary Examiner* — Manish S Shah
*Assistant Examiner* — Yaovi Ameh
(74) *Attorney, Agent, or Firm* — Birch, Stewart, Kolasch & Birch, LLP

(57) ABSTRACT

The image recording apparatus includes: a recording head in which a plurality of recording elements are arranged over a length corresponding to a recordable width of a recording medium; a conveyance device which performs conveyance to cause the recording head and the recording medium to move relatively to each other one time only in a conveyance direction, a reference line being arranged on the conveyance device; an image output device which records a prescribed image on the recording medium through the recording head; a sensor which reads the reference line on the conveyance device, and reads the prescribed image on the recording medium recorded by the image output device; and a displacement evaluation device which evaluates a displacement between the reference line and the recording head in accordance with a result of reading the reference line by the sensor and a result of reading the prescribed image by the sensor.

11 Claims, 11 Drawing Sheets

IMAGE RECORDING APPARATUS AND METHOD OF ADJUSTING RECORDING HEAD IN IMAGE RECORDING APPARATUS

BACKGROUND OF THE INVENTION

1. Field of the Invention

The present invention relates to an image recording apparatus and a method of adjusting a recording head in an image recording apparatus, more particularly to technology for adjusting a recording timing of a recording head and a position to attach the recording head.

2. Description of the Related Art

For an image recording apparatus with a recording head in which a plurality of nozzles for ejecting ink are arranged, there have been proposed many technologies for correcting an attachment position to attach the recording head, in order to prevent uneven printing that is caused by the displacement of the attachment position of the recording head when the image recording apparatus is vibrated upon transportation thereof or when the recording head is replaced.

Japanese Patent Application Publication No. 07-323582, for example, discloses an image forming apparatus based on an inkjet recording system that forms images by using a plurality of recording heads. The image forming apparatus has: a replacement detection means for detecting that at least one of the recording heads is replaced; a printing means for printing parallel two patterns by using a standard head and another head out of the recording heads when the replacement of the recording head was detected by the replacement detection means; a reading means for reading the parallel two patterns printed by the printing means; a position calculation means for calculating a position of a center dot on each of the patterns read by the reading means; and a displacement calculation means for calculating, from the position of the center dot on each pattern calculated by the position calculation means, a width between the patterns made by the standard head and a width between the patterns made by the standard head and the other head, and calculating an amount of displacement of the recording heads based on a difference between the widths.

This technology can accurately evaluate the displacement between the recording heads caused by replacing and attaching the recording heads, as well as the displacement caused by reciprocating printing. However, it is disadvantageous in that if the standard head has been displaced, the replaced heads are similarly displaced since the amount of displacement is calculated with respect to the standard head. An additional problem is that, when replacing all of the recording heads, there is no standard head to apply.

SUMMARY OF THE INVENTION

The present invention has been contrived in view of these circumstances, and an object thereof is to provide an image recording apparatus and a method of adjusting a recording head in the image recording apparatus, the image recording apparatus and the method being capable of adjusting the recording head based on a highly accurate reference.

In order to attain the aforementioned object, the present invention is directed to an image recording apparatus, comprising: a recording head in which a plurality of recording elements are arranged over a length corresponding to a recordable width of a recording medium; a conveyance device which performs conveyance to cause the recording head and the recording medium to move relatively to each other one time only in a conveyance direction, a reference line being arranged on the conveyance device; an image output device which records a prescribed image on the recording medium through the recording head; a sensor which reads the reference line on the conveyance device, and reads the prescribed image on the recording medium recorded by the image output device; and a displacement evaluation device which evaluates a displacement between the reference line and the recording head in accordance with a result of reading the reference line by the sensor and a result of reading the prescribed image by the sensor.

According to this aspect of the present invention, the displacement between the recording head and the reference line on the conveyance device is evaluated by using the sensor to read the output image and the reference line. Therefore, the recording head can be adjusted based on a highly accurate reference with no operation error.

Preferably, the reference line is a straight line perpendicular to the conveyance direction.

According to this aspect of the present invention, the displacement of the recording head can be evaluated appropriately.

Preferably, the image recording apparatus further comprises: an angle calculation device which calculates an angle of the recording head with respect to the conveyance direction in accordance with the evaluated displacement; and a turning angle output device which outputs the calculated angle to a display device.

According to this aspect of the present invention, the operator can be notified of the turning angle with respect to the conveyance direction.

Preferably, the image recording apparatus further comprises an angle adjustment device which adjusts the angle of the recording head with respect to the conveyance direction.

According to this aspect of the present invention, the operator can adjust the angle of the recording head with respect to the conveyance direction.

Preferably, the image recording apparatus further comprises: an angle calculation device which calculates an angle of the recording head with respect to the conveyance direction in accordance with the evaluated displacement; a head turning device which turns the recording head with respect to the conveyance direction; and a control device which controls the head turning device in accordance with the calculated angle.

According to this aspect of the present invention, the angle of the recording head with respect to the conveyance direction can be adjusted automatically.

Preferably, the recording head includes a plurality of head modules connected to each other, each of the head modules having part of the recording elements; and the image recording apparatus further comprises: a signal acquisition device which acquires a synchronization signal synchronizing with the conveyance of the conveyance device; a delay time calculation device which calculates a time of delay from the synchronization signal for each of the head modules in accordance with the evaluated displacement; and a delay time output device which outputs the calculated time of delay for each of the head modules, to the display device.

According to this aspect of the present invention, the operator can be notified of the delay time from the synchronous signal for each of the head modules constituting the recording head.

Preferably, the image recording apparatus further comprises a recording timing correction device which corrects a recording timing for each of the head modules in accordance with the calculated time of delay.

According to this aspect of the present invention, the operator can correct the recording timing for each head module.

Preferably, the conveyance device includes a rotary drum which conveys the recording medium; and the reference line is arranged on a thin plate wrapped around the rotary drum.

According to this aspect of the present invention, not only is it possible to appropriately form the reference line, but also the reference line can be easily read by the sensor.

Preferably, the sensor is configured also to inspect a recording quality of each of the recording elements.

According to this aspect of the present invention, the recording head can be adjusted without increasing the number of constituent members.

Preferably, a reading cycle of the sensor is unrelated with a conveyance speed of the conveyance device; and when the displacement evaluation device evaluates the displacement between the reference line and the recording head, the conveyance device sets the conveyance speed to be lower than the conveyance speed when the sensor inspects the recording quality of each of the recording elements.

According to this aspect of the present invention, even when the sensor for normal quality inspection is used for the adjustment, the recording head can be appropriately adjusted with a resolution higher than the resolution used in the quality inspection.

In order to attain the aforementioned object, the present invention is directed to a method of adjusting a recording head in an image recording apparatus including: a recording head in which a plurality of recording elements are arranged over a length corresponding to a recordable width of a recording medium, the recording head including a plurality of head modules connected to each other, each of the head modules having part of the recording elements; a conveyance device which performs conveyance to cause the recording head and the recording medium to move relatively to each other one time only in a conveyance direction, a reference line being arranged on the conveyance device; a signal acquisition device which acquires a synchronization signal synchronizing with the conveyance of the conveyance device; an image output device which records a prescribed image on the recording medium through the recording head; a sensor which reads the reference line on the conveyance device, and reads the prescribed image on the recording medium recorded by the image output device, the method comprising the steps of: reading the reference line on the conveyance device, by using the sensor; reading the prescribed image on the recording medium recorded by the image output device, by using the sensor; evaluating a displacement between the reference line and the recording head in accordance with a result obtained in the step of reading the reference line and a result obtained in the step of reading the prescribed image; calculating a time of delay from the synchronization signal for each of the head modules in accordance with the displacement evaluated in the step of evaluating; and correcting a recording timing for each of the head modules in accordance with the time of delay calculated in the step of calculating.

According to this aspect of the present invention, the displacement between the recording head and the reference line on the conveyance device is evaluated by using the sensor to read the reference line and the output image, and the recording timing for each head module is corrected. Therefore, the fluctuation of each head module can be corrected based on the highly accurate reference with no operation error.

Thus, the present invention is capable of adjusting the recording head based on the highly accurate reference.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Composition of Inkjet Image Forming Apparatus

Figure 1:
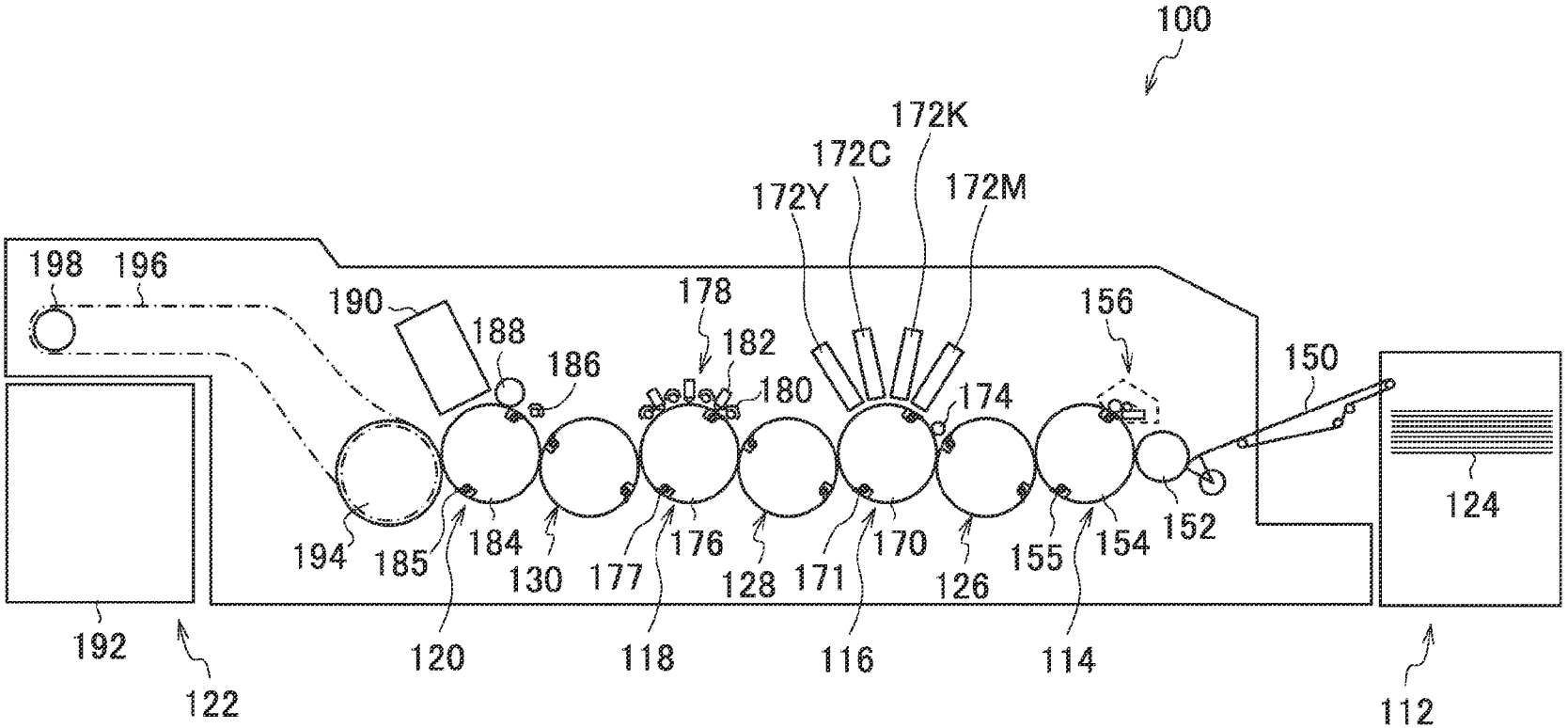
FIG. 1 is an entire structural diagram illustrating the configuration of an inkjet image forming apparatus.

FIG. 1 is a structural diagram illustrating the configuration of an inkjet image forming apparatus 100 according to an embodiment of the present invention. The inkjet image forming apparatus 100 includes a paper feed unit 112, a treatment liquid deposition unit (pre-coating unit) 114, an image formation unit 116, a drying unit 118, a fixing unit 120, and a paper output unit 122 as the main components.

The inkjet image forming apparatus 100 is of a single-pass system which forms a desired color image on a recording medium (hereinafter also referred to as "paper") 124 held on a pressure drum (an image formation drum 170) of an image formation unit 116 by ejecting and depositing droplets of ink of a plurality of colors from inkjet heads 172M, 172K, 172C and 172Y onto the recording medium 124, and is of an on-demand type which adapts a two-liquids reaction (aggregation in the present embodiment) system in which treatment liquid (aggregation treatment liquid in the present embodiment) is deposited onto the recording medium 124 prior to the deposition of the ink, so that the deposited ink reacts with the treatment liquid to form images on the recording medium 124.

<Paper Feed Unit>

The recording media (e.g., paper sheets) 124 are stacked in the paper feed unit 112. The paper feed unit 112 is provided with a paper feed tray 150, and feeds the recording media 124, sheet by sheet, through the paper feed tray 150 to the treatment liquid deposition unit 114. It is possible to use recording media of different types and various sizes as the recording media 124. A mode can be adopted in which the paper feed unit 112 is provided with a plurality of paper trays (not illustrated) in which recording media of different types are respectively sorted and stacked, and the paper that is fed to the paper feed tray 150 from the paper trays is automatically switched, and a mode can also be adopted in which an operator selects or exchanges the paper tray in accordance with requirements. In the present embodiment, cut sheets of paper are used as the recording media 124, but it is also possible to cut paper to a required size from a continuous roll of paper and then supply this cut sheet of the paper.

<Treatment Liquid Deposition Unit>

The treatment liquid deposition unit 114 is a mechanism that deposits the treatment liquid onto the recording surface of the recording medium 124. The treatment liquid includes a coloring material aggregating agent that causes the aggregation of a coloring material (pigment in the present embodiment) contained in the ink to be deposited in the image formation unit 116, and the separation of the coloring material and a solvent in the ink is enhanced when the treatment liquid is brought into contact with the ink.

The treatment liquid deposition unit 114 includes a paper transfer drum 152, a treatment liquid drum (referred also to as a "pre-coating drum") 154, and a treatment liquid application device 156. The treatment liquid drum 154 is a drum that holds and rotationally conveys the recording medium 124. The treatment liquid drum 154 is provided on the outer circumferential surface thereof with a hook-shaped holding device (gripper) 155, which holds the leading end of the recording medium 124 by gripping the recording medium 124 between the hook of the gripper 155 and the circumferential surface of the treatment liquid drum 154. The treatment liquid drum 154 can be provided with suction apertures on the outer circumferential surface thereof and connected to a suction device that performs suction through the suction apertures. As a result, the recording medium 124 can be tightly held on the outer circumferential surface of the treatment liquid drum 154.

The treatment liquid application device 156 is disposed on the outside of the treatment liquid drum 154 opposite the outer circumferential surface thereof. The treatment liquid application device 156 includes: a treatment liquid container, in which the treatment liquid to be applied is held; an anilox roller, a part of which is immersed in the treatment liquid held in the treatment liquid container; and a rubber roller, which is pressed against the anilox roller and the recording medium 124 that is held by the treatment liquid drum 154, so as to transfer the treatment liquid metered by the anilox roller to the recording medium 124. The treatment liquid application device 156 can apply the treatment liquid onto the recording medium 124 while metering.

In the present embodiment, the application system using the roller is employed; however, the present invention is not limited to this, and it is possible to employ a spraying method, an inkjet method, or other methods of various types.

The recording medium 124 on which the treatment liquid has been deposited in the treatment liquid deposition unit 114 is transferred from the treatment liquid drum 154 through the intermediate conveyance unit 126 to the image formation drum 170 of the image formation unit 116.

<Image Formation Unit>

The image formation unit 116 includes the image formation drum (referred also to as a "jetting drum") 170, a paper pressing roller 174 and the inkjet heads 172M, 172K, 172C and 172Y. Similar to the treatment liquid drum 154, the image formation drum 170 is provided on the outer circumferential surface thereof with a hook-shaped holding device (gripper) 171. The recording medium 124 held on the image formation drum 170 is conveyed in a state where the recording surface thereof faces outward, and inks are deposited onto the recording surface by the inkjet heads 172M, 172K, 172C and 172Y.

The inkjet heads 172M, 172K, 172C and 172Y are recording heads (inkjet heads) of the inkjet system of the full line type that have a length corresponding to the maximum width of the image formation region in the recording medium 124. Rows of nozzles (two-dimensionally arranged nozzles) are formed on the ink ejection surface of the inkjet head. Each nozzle row has a plurality of nozzles arranged therein for discharging ink over the entire width of the image recording region. Each of the inkjet heads 172M, 172K, 172C and 172Y is fixedly disposed so as to extend in the direction perpendicular to the conveyance direction (rotation direction of the image formation drum 170) of the recording medium 124.

The image formation drum 170 is provided with an encoder (not shown) to measure a rotational speed of the image formation drum 170. Ejection timings of the inkjet heads 172M, 172K, 172C and 172Y are controlled according to data obtained with the encoder, and thereby the ejected droplets can be precisely deposited on the recording medium 124.

Droplets of corresponding colored inks are ejected from the inkjet heads 172M, 172K, 172C and 172Y toward the recording surface of the recording medium 124 held tightly on the image formation drum 170, and thereby the ink comes into contact with the treatment liquid that has been heretofore deposited on the recording surface by the treatment liquid deposition unit 114, the coloring material (pigment) dispersed in the ink is aggregated, and a coloring material aggregate is formed. Thus, the coloring material flow on the recording medium 124 is prevented, and an image is formed on the recording surface of the recording medium 124.

In the present embodiment, the CMYK standard color (four colors) configuration is described, but combinations of ink colors and numbers of colors are not limited to that of the present embodiment, and if necessary, light inks, dark inks, and special color inks may be added. For example, a configuration is possible in which inkjet heads are added that eject light inks such as light cyan and light magenta. The arrangement order of color heads is also not limited.

The recording medium 124 on which the image has been formed in the image formation unit 116 is transferred from the image formation drum 170 through an intermediate conveyance unit 128 to a drying drum 176 of the drying unit 118.

<Drying Unit>

The drying unit 118 dries water included in the solvent separated by the coloring material aggregation action. As shown in FIG. 1, the drying unit includes the drying drum 176 and a solvent dryer 178.

Similar to the treatment liquid drum 154, the drying drum 176 is provided on the outer circumferential surface thereof with a hook-shaped holding device (gripper) 177, which can hold the recording medium 124 by gripping the leading end portion of the recording medium 124.

The solvent dryer 178 is disposed in a position facing the outer circumferential surface of the drying drum 176, and includes a plurality of halogen heaters 180, and a plurality of warm-air blow-out nozzles 182, each of which is arranged between adjacent two of the halogen heaters 180.

Each of the warm-air blow-out nozzles 182 is controlled to blow warm air at appropriate temperature at an appropriate blowing rate toward the recording medium 124, and each of the halogen heaters 180 is controlled to appropriate temperature, and it is thereby possible to implement various drying conditions.

The surface temperature of the drying drum 176 is set to 50° C. or above. By heating from the rear side of the recording medium 124, drying is promoted and breaking of the image during fixing can be prevented. There are no particular restrictions on the upper limit of the surface temperature of the drying drum 176, but from the viewpoint of the safety of maintenance operations such as cleaning the ink adhering to the surface of the drying drum 176 (namely, preventing burns due to high temperature), desirably, the surface temperature of the drying drum 176 is not higher than 75° C. (and more desirably, not higher than 60° C.).

By holding the recording medium 124 in such a manner that the recording surface thereof is facing outward on the outer circumferential surface of the drying drum 176 (in other words, in a state where the recording surface of the recording medium 124 is curved in a convex shape), and drying while conveying the recording medium in rotation, it is possible to prevent the occurrence of wrinkles or floating up of the recording medium 124, and therefore drying non-uniformities caused by these phenomena can be prevented reliably.

The recording medium 124 which has been subjected to the drying treatment in the drying unit 118 is transferred from the drying drum 176 through an intermediate conveyance unit 130 to a fixing drum 184 of the fixing unit 120.

<Fixing Unit>

The fixing unit 120 includes the fixing drum 184, a halogen heater 186, a fixing roller 188, and an in-line sensor 190. Similar to the treatment liquid drum 154, the fixing drum 184 is provided on the outer circumferential surface thereof with a hook-shaped holding device (gripper) 185, which can hold the recording medium 124 by gripping the leading end portion of the recording medium 124. The fixing drum 184 is provided with a ceramics jacket 400 (see FIG. 7) for preventing the ink from adhering and accumulating on the surface of the fixing drum 184.

The recording medium 124 is conveyed by rotation of the fixing drum 184 in a state where the recording surface thereof faces outward, and the preheating by the halogen heater 186, the fixing treatment by the fixing roller 188 and the inspection by the in-line sensor 190 are performed with respect to the recording surface.

The halogen heater 186 is controlled to a prescribed temperature (for example, 180° C.), by which the preheating is performed with respect to the recording medium 124.

The fixing roller 188 is a roller member which applies pressure and heat to the dried ink to melt and fix the self-dispersible polymer particles in the ink so as to transform the ink into the film. The fixing roller 188 is configured so as to apply pressure and heat to the recording medium 124. More specifically, the fixing roller 188 is arranged so as to be pressed against the fixing drum 184, and a nip roller is configured between the fixing roller 188 and the fixing drum 184. As a result, the recording medium 124 is squeezed between the fixing roller 188 and the fixing drum 184, nipped under a prescribed nip pressure (for example, 0.15 MPa), and subjected to fixing treatment.

Further, the fixing roller 188 is configured by a heating roller in which a halogen lamp is incorporated in a metal pipe, for example made from aluminum, having good thermal conductivity and the rollers are controlled to a prescribed temperature (for example 60° C. to 80° C.). Where the recording medium 124 is heated with the heating roller, thermal energy not lower than a Tg temperature (glass transition temperature) of a latex included in the ink is applied and latex particles are melted. As a result, fixing is performed by penetration into the projections-recessions of the recording medium 124, the projections-recessions of the image surface are leveled out, and gloss is obtained.

The fixing unit 120 in the embodiment shown in FIG. 1 is provided with the single fixing roller 188; however, it is possible that the fixing roller 188 has a configuration provided with a plurality of steps, dependently on the thickness of image layer and Tg characteristic of latex particles.

On the other hand, the in-line sensor 190 is a measuring device which measures the ejection failure check pattern, moisture amount, surface temperature, gloss, and the like of the image (including a test pattern, and the like) recorded on the recording medium 124. A CCD sensor or the like can be used for the in-line sensor 190.

With the fixing unit 120 of the above-described configuration, the latex particles located within a thin image layer formed in the drying unit 118 are melted by application of pressure and heat by the fixing roller 188. Thus, the latex particles can be reliably fixed to the recording medium 124. The surface temperature of the fixing drum 184 is set to 50° C. or above. Drying is promoted by heating the recording medium 124 held on the outer circumferential surface of the fixing drum 184 from the rear side, and therefore breaking of the image during fixing can be prevented, and furthermore, the strength of the image can be increased by the effects of the increased temperature of the image.

It is possible to use an ink containing a monomer component that can be polymerized and cured when irradiated with ultraviolet (UV) light, instead of the ink containing the high-boiling point solvent and the polymer particles (thermoplastic resin particles). In this case, the inkjet image formation apparatus 100 is provided with a UV irradiation unit to irradiate the ink having been deposited on the recording medium 124 with UV light, instead of the heat-pressure fixing unit having the heat roller (the fixing roller 188). If using an ink containing an active light-curable resin, such as a UV-curable resin, instead of the ink containing the thermoplastic resin particles, then the inkjet image formation apparatus 100 is thus provided with a device which irradiates the active light, such as a UV lamp or a UV laser diode (LD) array, instead of the fixing roller 188 for heat fixing.

<Paper Output Unit>

As shown in FIG. 1, the paper output unit 122 is arranged after the fixing unit 120. The paper output unit 122 includes a paper output tray 192. A transfer drum 194, a pair of endless conveyance belts 196, and a tension roller 198 are arranged between the fixing drum 184 of the fixing unit 120 and the paper output tray 192, so as to face the fixing drum 184 and the paper output tray 192. The recording medium 124 is conveyed through the transfer drum 194 to the conveyance belts 196, and is then outputted to the paper output tray 192. Although detailed composition of the paper conveyance mechanism with the conveyance belts 196 is not shown in the drawings, the recording medium 124 on which the image has formed is transferred while the leading end thereof is held with grippers arranged on a bar (not shown) connecting the pair of endless conveyance belts 196, to a position over the paper output tray 192 by the rotation of the conveyance belts 196.

Although not illustrated in FIG. 1, the inkjet image forming apparatus 100 of the present embodiment includes, in addition to the configuration described above: an ink storing/loading unit for supplying the inks to the inkjet heads 172M, 172K, 172C and 172Y; a device for supplying treatment liquid to the treatment liquid deposition unit 114; a head maintenance unit for cleaning the inkjet heads 172M, 172K, 172C and 172Y (wiping the nozzle surface, purging, suctioning the nozzles, etc.); a position determination sensor for determining the position of the recording medium 124 on a paper conveyance path; and a temperature sensor for measuring the temperature of each of the units arranged in the apparatus.

<Embodiments of Structure of Inkjet Head>

Next, the structure of inkjet heads is described. The respective inkjet heads 172M, 172K, 172C and 172Y have the same structure, and any of the recording heads is hereinafter referred to as a head 250.

Figure 2A:
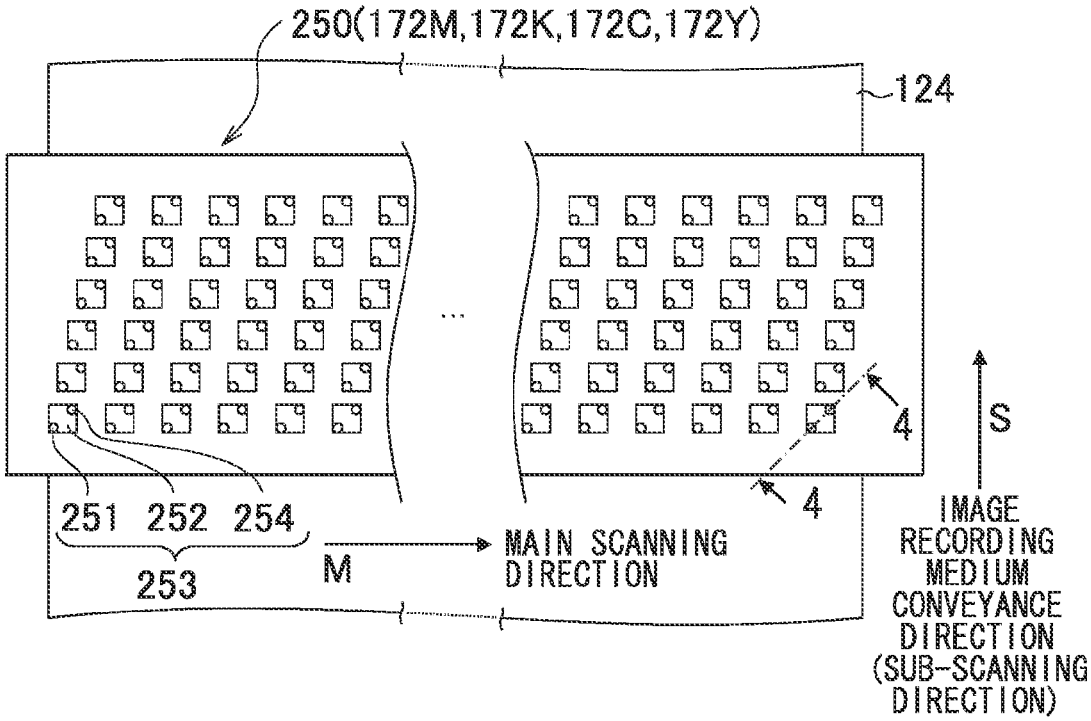
FIGS. 2A and 2B are plan perspective diagrams illustrating an embodiment of the structure of a recording head.
Figure 2B:
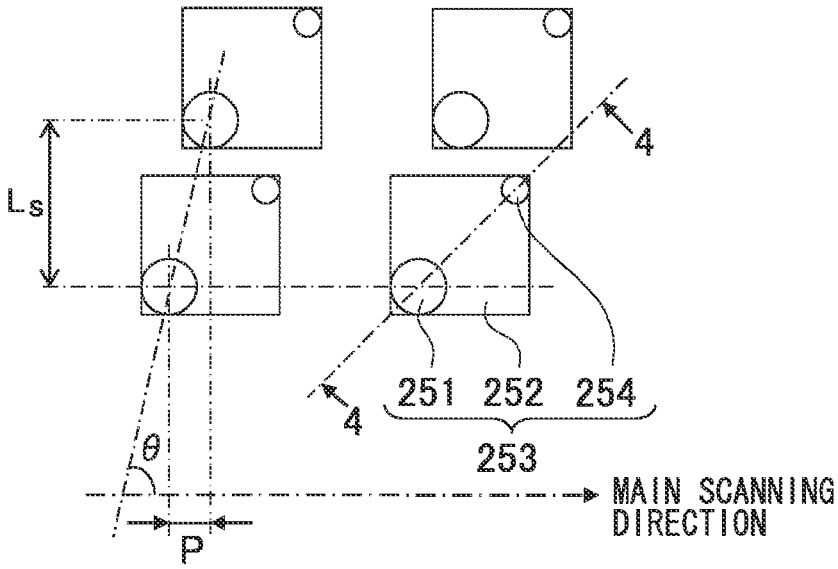
Figure 3A:
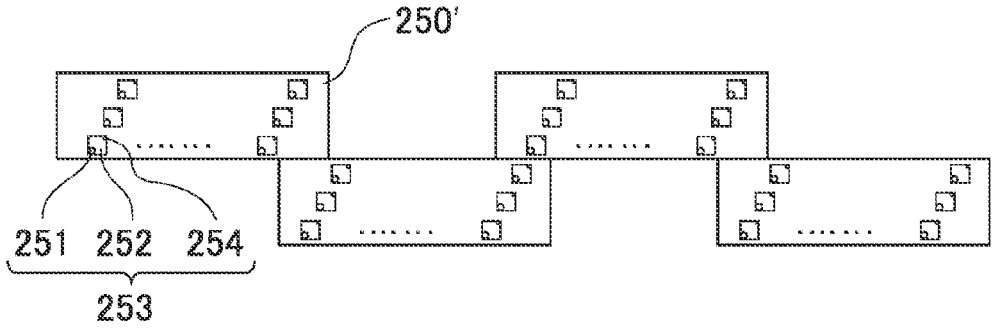
FIGS. 3A and 3B are plan perspective diagrams illustrating other embodiments of the structure of the recording head.
Figure 3B:
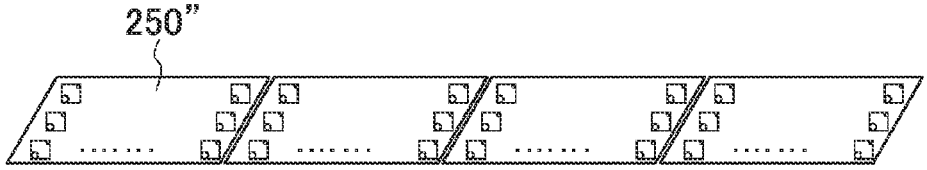
Figure 4:
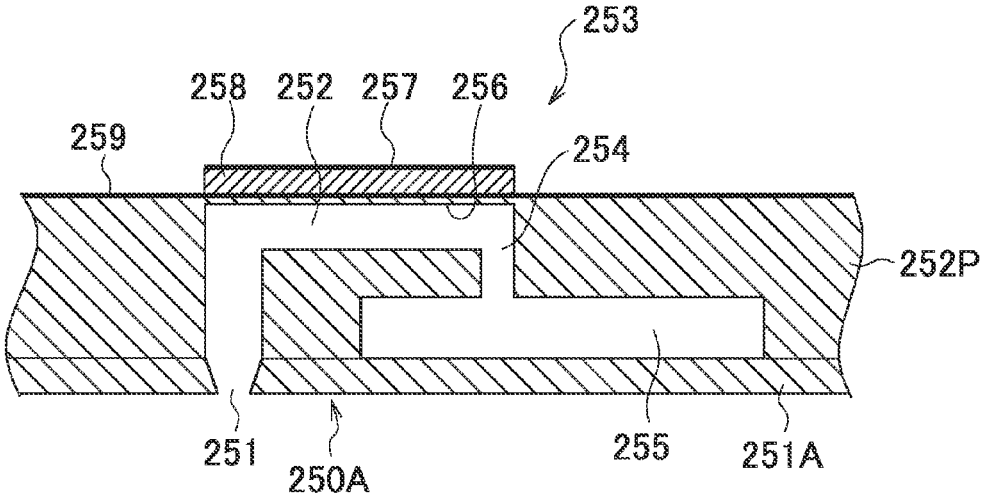
FIG. 4 is a cross-sectional diagram illustrating the inner configuration of a droplet ejection element.

FIG. 2A is a plan perspective diagram illustrating an embodiment of the structure of the head 250, and FIG. 2B is a partial enlarged diagram of same. Moreover, FIGS. 3A and 3B are planar perspective views illustrating other structural embodiments of heads, and FIG. 4 is a cross-sectional diagram illustrating a liquid droplet ejection element for one channel being a recording element unit (an ink chamber unit corresponding to one nozzle 251) (a cross-sectional diagram along line 4-4 in FIGS. 2A and 2B).

As illustrated in FIGS. 2A and 2B, the head 250 according to the present embodiment has a structure in which a plurality of ink chamber units (liquid droplet ejection elements) 253, each having a nozzle 251 forming an ink droplet ejection aperture, a pressure chamber 252 corresponding to the nozzle 251, and the like, are disposed two-dimensionally in the form of a staggered matrix, and hence the effective nozzle interval (the projected nozzle pitch) as projected (orthographically-projected) in the lengthwise direction of the head (the direction perpendicular to the paper conveyance direction) is reduced and high nozzle density is achieved.

The mode of forming nozzle rows which have a length equal to or more than the entire width Wm of the recording area of the recording medium 124 in a direction (direction indicated by arrow M) substantially perpendicular to the paper conveyance direction (direction indicated by arrow S) of the recording medium 124 is not limited to the embodiment described above. For example, instead of the configuration in FIG. 2A, as illustrated in FIG. 3A, a line head having nozzle rows of a length corresponding to the entire width Wm of the recording area of the recording medium 124 can be formed by arranging and combining, in a staggered matrix, short head modules 250' having a plurality of nozzles 251 arrayed in a two-dimensional fashion. It is also possible to arrange and combine short head modules 250" in a line as shown in FIG. 3B.

The nozzle rows required for image formation in a prescribed image formation region can be formed not only for the entire surface of the recording medium 124 taken as an image formation range, but also for only part of the surface of the recording medium 124 constituting the image formation region (i.e., when a non-image formation region (blank space) is provided in the circumference of the sheet).

The pressure chamber 252 provided to each nozzle 251 has substantially a square planar shape (see FIGS. 2A and 2B), and has an outlet port for the nozzle 251 at one of diagonally opposite corners and an inlet port (supply port) 254 for receiving the supply of the ink at the other of the corners. The planar shape of the pressure chamber 252 is not limited to this embodiment and can be various shapes including quadrangle (rhombus, rectangle, etc.), pentagon, hexagon, other polygons, circle, and ellipse.

As illustrated in FIG. 4, the head 250 is configured by stacking and joining together a nozzle plate 251A, in which the nozzles 251 are formed, a flow channel plate 252P, in which the pressure chambers 252 and the flow channels including the common flow channel 255 are formed, and the like. The nozzle plate 251A constitutes a nozzle surface (ink ejection surface) 250A of the head 250 and has formed therein the two-dimensionally arranged nozzles 251 communicating respectively to the pressure chambers 252.

The flow channel plate 252P constitutes lateral side wall parts of the pressure chamber 252 and serves as a flow channel formation member, which forms the supply port 254 as a limiting part (the narrowest part) of the individual supply channel leading the ink from a common flow channel 255 to the pressure chamber 252. FIG. 4 is simplified for the convenience of explanation, and the flow channel plate 252P may be structured by stacking one or more substrates.

The nozzle plate 251A and the flow channel plate 252P can be made of silicon and formed in the prescribed shapes by means of the semiconductor manufacturing process.

The common flow channel 255 is connected to an ink tank (not shown), which is a base tank for supplying ink, and the ink supplied from the ink tank is delivered through the common flow channel 255 to the pressure chambers 252.

A piezoelectric actuator 258 having an individual electrode 257 is connected on a diaphragm 256 constituting a part of faces (the ceiling face in FIG. 4) of the pressure chamber 252. The diaphragm 256 in the present embodiment is made of silicon (Si) having a nickel (Ni) conductive layer serving as a common electrode 259 corresponding to lower electrodes of a plurality of piezoelectric actuators 258, and also serves as the common electrode of the piezoelectric actuators 258, which are disposed on the respective pressure chambers 252. The diaphragm 256 can be formed by a non-conductive material such as resin; and in this case, a common electrode layer made of a conductive material such as metal is formed on the surface of the diaphragm member. It is also possible that the diaphragm is made of metal (an electrically-conductive material) such as stainless steel (SUS), which also serves as the common electrode.

When a drive voltage is applied between the individual electrode 257 and the common electrode 259, the piezoelectric actuator 258 is deformed, the volume of the pressure chamber 252 is thereby changed, and the pressure in the pressure chamber 252 is thereby changed, so that the ink inside the pressure chamber 252 is ejected through the nozzle 251. When the displacement of the piezoelectric actuator 258 is returned to its original state after the ink is ejected, new ink is refilled in the pressure chamber 252 from the common flow channel 255 through the supply port 254.

As illustrated in FIG. 2B, the plurality of ink chamber units 253 having the above-described structure are arranged in a prescribed matrix arrangement pattern in a line direction along the main scanning direction and a column direction oblique at an angle of θ with respect to the main scanning direction, and thereby the high density nozzle head is formed in the present embodiment. In this matrix arrangement, the nozzles 251 can be regarded to be equivalent to those substantially arranged linearly at a fixed pitch $P=Ls/\tan\theta$ along the main scanning direction, where Ls is a distance between the nozzles adjacent in the sub-scanning direction.

In implementing the present invention, the mode of arrangement of the nozzles 251 in the head 250 is not limited to the embodiments in the drawings, and various nozzle arrangement structures can be employed. For example, instead of the matrix arrangement as described in FIGS. 2A and 2B, it is also possible to use an undulating nozzle arrangement, such as a V-shaped nozzle arrangement, or zigzag configuration (W-shape arrangement), which repeats units of V-shaped nozzle arrangements.

The devices which generate pressure (ejection energy) applied to eject droplets from the nozzles in the inkjet head is not limited to the piezoelectric actuator (piezoelectric elements), and can employ various pressure generation devices (energy generation devices), such as heaters in a thermal system (which uses the pressure resulting from film boiling by the heat of the heaters to eject ink) and various actuators in other systems. According to the ejection system employed in the head, the corresponding energy generation devices are arranged in the flow channel structure body.

<Description of Control System>

Figure 5:
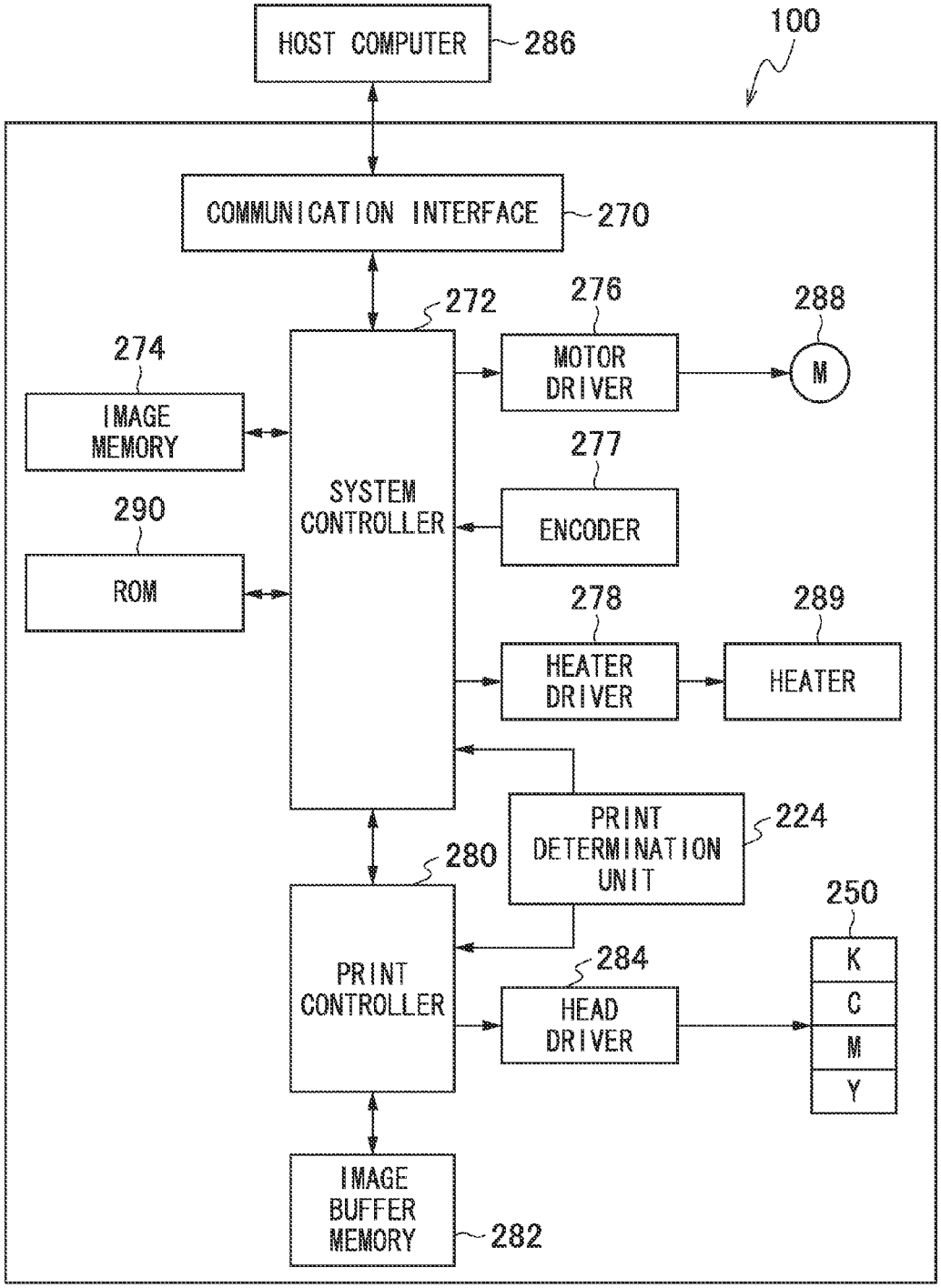
FIG. 5 is a block diagram showing the main system configuration of the inkjet image forming apparatus.

FIG. 5 is a block diagram showing the main system configuration of the inkjet image forming apparatus 100. The inkjet image forming apparatus 100 includes a communication interface 270, a system controller 272, a memory 274, a motor driver 276, a heater driver 278, a print controller 280, an image buffer memory 282, a head driver 284, a ROM 290, a print determination unit 224, an encoder 277, and the like.

The communication interface 270 is an interface unit for receiving image data sent from a host computer 286. A serial interface such as USB (Universal Serial Bus), IEEE1394, Ethernet (registered trademark), and wireless network, or a parallel interface such as a Centronics interface may be used as the communication interface 270. A buffer memory (not shown) may be mounted in this portion in order to increase the communication speed. The image data sent from the host computer 286 is received by the inkjet image forming apparatus 100 through the communication interface 270, and is temporarily stored in the memory 274.

The memory 274 is a storage device for temporarily storing images inputted through the communication interface 270, and data is written and read to and from the image memory 274 through the system controller 272. The memory 274 is not limited to a memory composed of semiconductor elements, and a hard disk drive or another magnetic medium may be used.

The system controller 272 is constituted of a central processing unit (CPU) and peripheral circuits thereof, and the like, and it functions as a control device for controlling the whole of the inkjet image forming apparatus 100 in accordance with a prescribed program, as well as a calculation device for performing various calculations. More specifically, the system controller 272 controls the various sections, such as the communication interface 270, memory 274, motor driver 276, heater driver 278, and the like, as well as controlling communications with the host computer 286 and writing and reading to and from the memory 274, and it also generates control signals for controlling the motor 288 and heater 289 of the conveyance system.

The ROM 290 stores various control programs and parameters, and the programs are read out and executed in accordance with commands from the system controller 272.

The memory 274 is used as a temporary storage region for the image data, and it is also used as a program development region and a calculation work region for the CPU.

The motor driver 276 drives the motor 288 in accordance with commands from the system controller 272. In FIG. 5, the motors arranged in the various sections in the inkjet image forming apparatus 100 are collectively denoted with the reference numeral 288.

The heater driver 278 drives the heater 289 in accordance with commands from the system controller 272. In FIG. 5, the heaters arranged in the various sections in the inkjet image forming apparatus 100 are collectively denoted with the reference numeral 289.

The print controller 280 is a control unit which has signal processing functions for performing various treatment processes, corrections, and the like, in accordance with the control implemented by the system controller 272, in order to generate a signal for controlling the image formation from the image data in the memory 274, and supplies the image formation data (dot image data) thus generated to the head driver 284.

In general, the dot image data is generated by subjecting the image data to color conversion processing and halftone processing. The color conversion processing is processing for converting image data represented by an sRGB system (e.g., 8-bit image data for each of the colors of R, G and B) for instance, into image data (the KCMY color data in the present embodiment) of the respective colors of ink used by the inkjet image forming apparatus 100.

The halftone processing is processing for converting the color data of the respective colors generated by the color conversion processing into dot data of respective colors (the KCMY dot data in the present embodiment) by error diffusion processing, a threshold value matrix method, or the like.

Prescribed signal processing is carried out in the print controller 280, and the ejection amount and the ejection timing of the ink droplets from the inkjet heads 250 are controlled through the head driver 284, on the basis of the obtained print data. Thus, prescribed dot size and dot positions can be achieved.

The print controller 280 is provided with the image buffer memory 282, and image data, parameters, and other data are temporarily stored in the image buffer memory 282 when image data is processed in the print controller 280. A mode is also possible in which the print controller 280 and the system controller 272 are integrated to form a single processor.

The head driver 284 can include a feedback control system for maintaining constant drive conditions in the head 250.

The inkjet image forming apparatus 100 of the present embodiment adopts a drive system in which the ink is ejected from the nozzles 251 corresponding to the piezoelectric actuators 258 by applying a common drive electric power waveform signal to the piezoelectric actuators 258 in the head 250 while turning on/off switch elements (not shown) connected to the individual electrodes of the piezoelectric actuators 258 in accordance with the ejection timing of the respective piezoelectric actuators 258.

The print determination unit 244 is a functional block which reads in the image printed on the recording medium 124 by each of the inkjet heads 172M, 172K, 172C and 172Y, performs various signal processing operations for the read data, and the like, and supplies subscribed information to the system controller 272. The print determination unit 244 includes the in-line sensor 190 shown in FIG. 1.

The encoder 277 is to measure the rotational speed of the image formation drum 170. For example, a photoelectric rotary encoder is used as the encoder 277. The system controller 272 calculates the rotational speed of the image formation drum 170 from a signal obtained by the encoder 277, generates ejection timing signals of the nozzles 251 of the inkjet heads 172M, 172K, 172C and 172Y of the respective colors on the basis of the calculated rotational speed, and supplies the ejection timing signals to the print controller 280. The print controller 280 counts a prescribed number of pulse delays and generates an encoder signal of the fixing drum 184 shown in FIG. 10.

It is possible that the processing functions of the system controller 272 described with reference to FIG. 5 are entirely or partially performed by the host computer 286.

Adjustment of Bar Heads in the Related Art

As illustrated in FIGS. 2A and 2B, the inkjet head 250 has a structure in which the nozzles 251 are disposed such that a desired (in terms of the design) resolution can be achieved when the nozzles 251 are projected in a prescribed direction. In other words, this prescribed direction needs to coincide with the direction perpendicular to the conveyance direction of the recording medium 124 (the direction indicated with the arrow S), in order for the inkjet head 250 to perform image formation on the recording medium 124 at the desired resolution.

Therefore, when attaching the inkjet heads 172M, 172K, 172C and 172Y of the respective colors at the time of manufacturing or when replacing the inkjet heads 172M, 172K, 172C and 172Y after shipment, the inkjet heads 172M, 172K, 172C and 172Y need to be attached in the positions described above.

In the structure in which the inkjet head 250 is constituted of the plurality of head modules 250' as shown FIG. 3A, the fluctuation between the respective head modules 250' caused at the time of manufacturing is considered to generate a fluctuation in an image formation result, even when the same control signals are input. In order to eliminate such fluctuation in the image formation, the ejection timing of each module needs to be adjusted. The same is true on the configuration shown in FIG. 3B.

Figure 6:
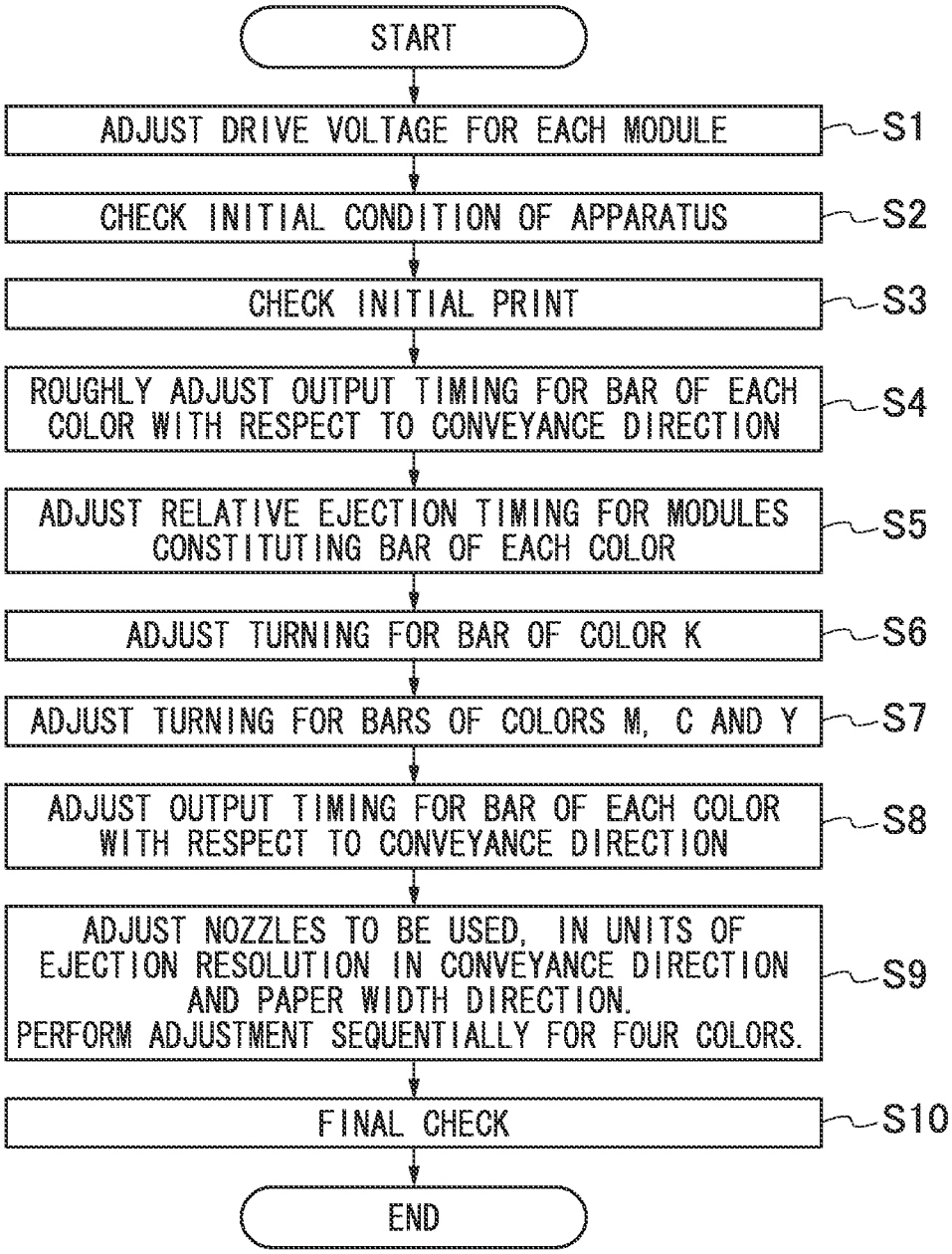
FIG.6 RELATED ART
FIG. 6 is a flowchart illustrating a method of adjusting a recording head in the related art.

The timing adjustments for the respective modules and the positional adjustments (turning adjustments) of the inkjet heads performed after attaching the inkjet heads 250 in the related art are described below. FIG. 6 is a flowchart illustrating the method of adjusting the recording head in the related art. Suppose that each inkjet head 250 is constituted of a plurality of head modules 250'.

First, the drive voltage to be applied to the individual electrodes 257 is adjusted for each head module in order to obtain an appropriate amount of droplets of the inks to be ejected (step S1).

Subsequently, the initial condition of the apparatus is checked (step S2), and thereafter the ink droplets are ejected from the inkjet heads 250 of the respective colors in order to form prescribed patterns on a sheet (step S3). The prescribed patterns here represent, for example, lines of the respective colors formed along the main scanning direction, wherein four lines overlap on one another.

Then, the operator visually checks the formed lines of the respective colors, and roughly adjusts the ejection timings of the inks of the four colors with respect to the encoder signal of the fixing drum 184 so that image formation positions where a color image is formed by the inkjet heads 250 of the four colors are all the same (step S4). Adjustment values can be inputted through the host computer 286 or through a user interface (not shown) included in the inkjet image forming apparatus 100.

The operator further adjusts the ejection timings for the respective head modules 250' based on the formed patterns of the respective colors so that the joints between the lines formed by the head modules 250' are connected in the inkjet head 250 of each color (step S5). This process is performed sequentially on the inkjet heads 250 of the four colors.

Then, the turning adjustment is performed on the inkjet head 250 of black (K) where color drift stands out most so that the image formation can be performed at right angle with respect to the paper conveyance direction (step S6). Subsequently, the turning adjustment is performed sequentially on the inkjet heads 250 of M, C and Y (step S7).

Again, with respect to the encoder signal of the fixing drum 184, output timings are adjusted so that the image formation positions of the inkjet heads 250 of the four colors are disposed evenly in line (step S8), and the nozzles that are used for the image formation at an ejection resolution of the inkjet heads 250 are adjusted in the paper conveyance direction and the main scanning direction (step S9).

Finally, prescribed patterns same as those obtained in step S3 are formed again on a sheet, which are visually checked by the operator (step S10). When further adjustment is required, the flow returns to step S4 to carry out the same processes.

In this manner, the inkjet image forming apparatus of a single-pass system, in which so-called bar heads are used, requires registration adjustment in which the above-described initial adjustment is carried out to adjust the image formation positions of the plurality of colors, every time of attachment and replacement of the heads. When there is a displacement in any of the image formation positions of the heads, an excellent color image cannot be formed, and color drift stands out in characters or detailed patterns, resulting in significant lowering of the print quality. Therefore, the operator is required to practice the precise adjustments.

First Embodiment

Timing adjustments for the respective modules of the inkjet heads and positional adjustments of the inkjet heads according to a first embodiment of the present invention are described below.

Figure 7:
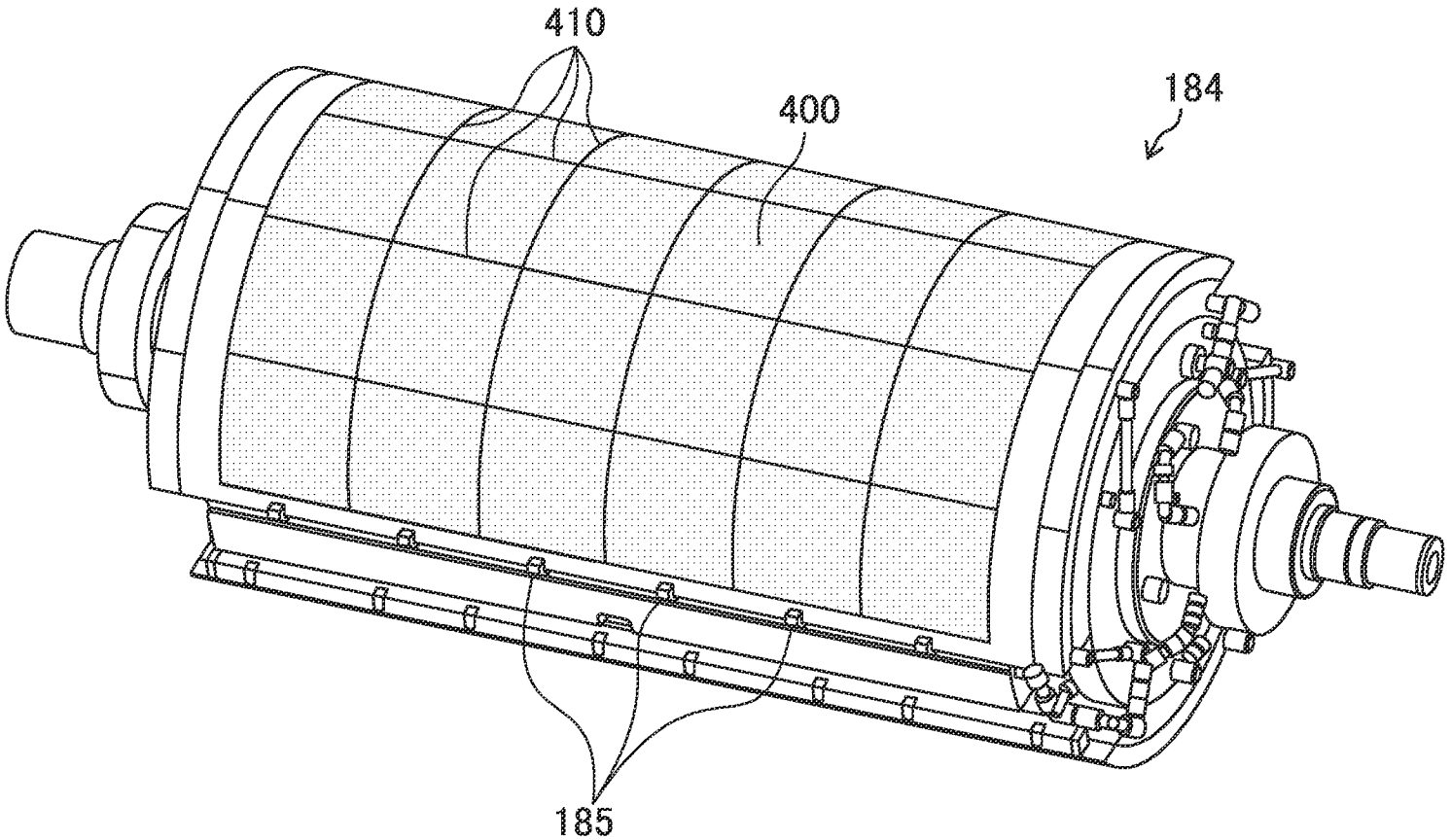
FIG. 7 is a diagram illustrating marked lines on a ceramics jacket.

As illustrated in FIG. 7, the surface of the fixing drum 184 is covered with the ceramics jacket 400 in which a ceramics layer is formed on a stainless-steel substrate (e.g., SUS304). A surface of the ceramics jacket 400 has marked lines 410, which form a grid pattern of a plurality of vertical lines and horizontal lines intersecting vertically with one another. The ceramics jacket 400 is attached to the fixing drum 184 such that the vertical and horizontal lines of the grid pattern become line segments that are perpendicular or parallel to the rotary shaft of the fixing drum 184. In other words, of the marked lines 410, the line segments that are parallel to the rotary shaft of the fixing drum 184 are perpendicular to the paper conveyance direction.

The marked lines 410 are not limited to scratched lines, and can be any types of lines drawn by ink or paint.

Figure 8:
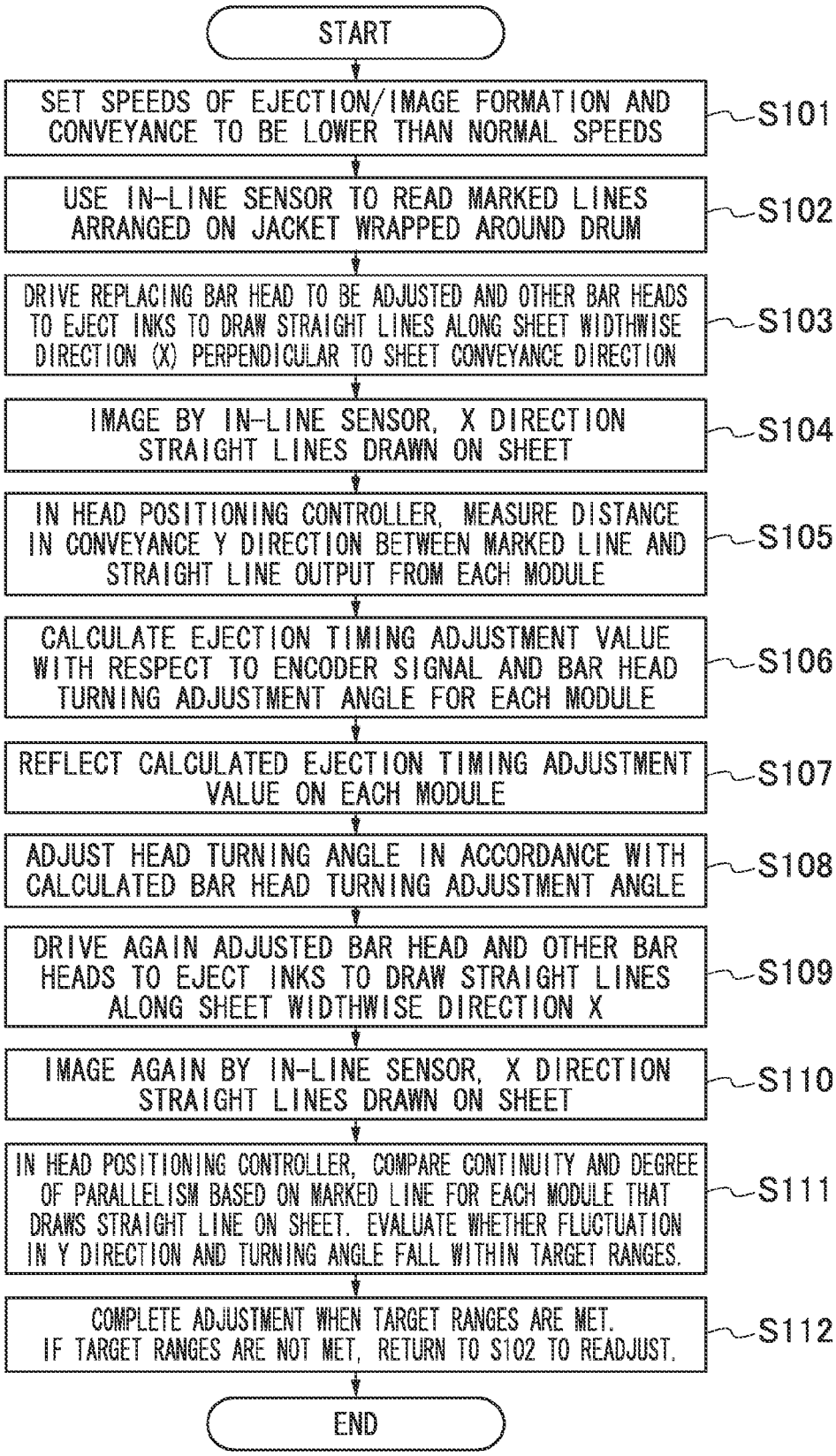
FIG. 8 is a flowchart illustrating a method of adjusting inkjet heads according to a first embodiment.

FIG. 8 is a flowchart illustrating a method of adjusting the inkjet heads according to the present embodiment. In the present embodiment as well, suppose that each inkjet head 250 is constituted of the plurality of head modules 250'. The following describes replacement of the inkjet head 172K of the K color out of the inkjet heads 250 of the four colors.

After the replacing K inkjet head 172K is mounted on the inkjet image forming apparatus 100, the operator sets the inkjet image forming apparatus 100 to a head adjustment mode. The mode setting can be performed through the host computer 286 or the user interface (not shown). Once the head adjustment mode is set, the inkjet image forming apparatus 100 sets the speed of ejection and image formation and the speed of conveyance to speeds lower than normal speeds (step S101).

In an operating state for normal print output, the inkjet image forming apparatus 100 sets the paper conveyance speed at 535 mm/sec and an imaging cycle of the in-line sensor 190 at 380 μsec. In the head adjustment mode, on the other hand, the paper conveyance speed is set at 53.5 mm/sec, 1/10 of the normal conveyance speed. In this case, the imaging cycle of the in-line sensor 190 is unrelated with the conveyance speed and is kept at 380 μsec. As a result, a reading resolution in the head adjustment mode is 0.02033 mm, which corresponds to approximately 1250 dpi. By setting the conveyance speed of the head adjustment mode to be lower than that used in normal image formation as described above, the resolution of the in-line sensor 190 is made higher than that used for inspecting test patterns and the like recorded on the recording medium 124.

Once the mode is set to the head adjustment mode, the inkjet image forming apparatus 100 rotates the conveyance drums including the fixing drum 184 at the above-described conveyance speed. The in-line sensor 190 of the print determination unit 224 reads the marked lines 410, which are arranged on the ceramics jacket 400 wrapped around the fixing drum 184 (step S102). Position reference data are generated from the read data on the marked lines 410.

Next, the replacing K inkjet head 172K to be adjusted is driven to draw a straight line on an output sheet along the main scanning direction perpendicular to the paper conveyance direction (step S103). Similarly, the C inkjet head 172C, M inkjet head 172M and Y inkjet head 172Y that are already mounted and not adjusted this time are also driven to draw straight lines on the same output sheet along the main scanning direction in the vicinity of the straight line drawn by the K inkjet head 172K.

Figure 9A:
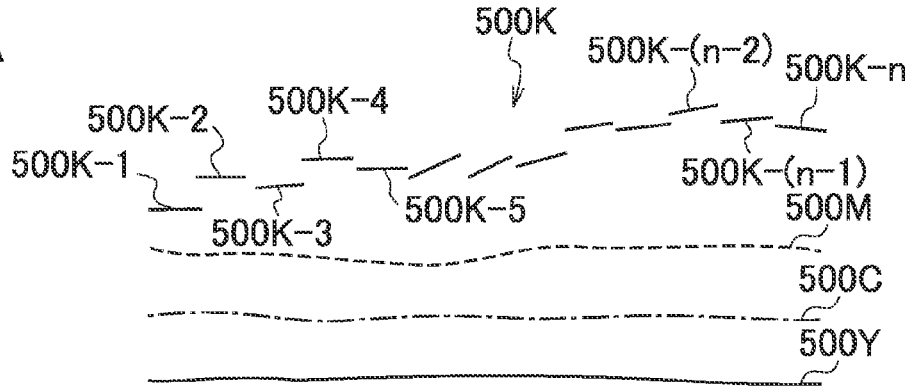
FIGS. 9A to 9D are diagrams illustrating straight lines drawn by the inkjet heads before and after the adjustment.

FIG. 9A is a diagram illustrating straight lines that are drawn on the output sheet by the inkjet heads 172, where 500K denotes collectively the straight lines drawn by the K inkjet head 172K, 500C denotes collectively the straight lines drawn by the C inkjet head 172C, 500M denotes collectively the straight lines drawn by the M inkjet head 172M, and 500Y denotes collectively the straight lines drawn by the Y inkjet head 172Y. Since the K inkjet head 172K is unadjusted, in the straight lines 500K, straight lines 500K-1, 500K-2, 500K-3, . . . , 500K-i, . . . , 500K-n that are respectively drawn by n number of the head modules 150'-1, 150'-2, 150'-3, . . . , 150'-*i*, . . . , 150'-*n* are discontinuous.

Figure 9B:
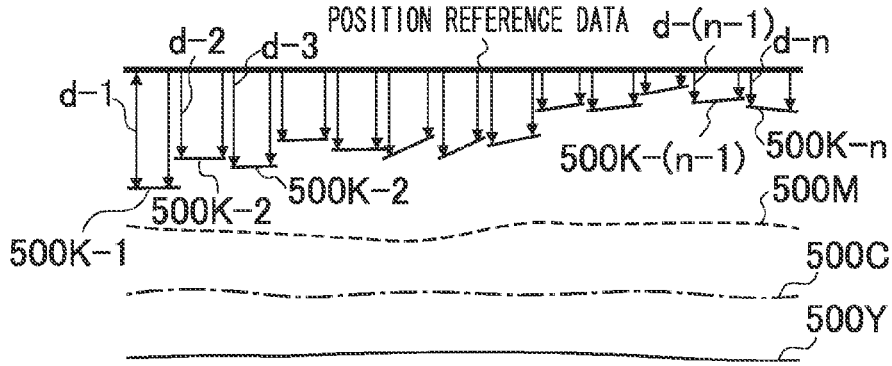

Subsequently, the in-line sensor 190 reads the lines 500K, 500M, 500C and 500Y drawn in the main scanning direction on the sheet (step S104). Based on these read data, a distance d-i between the position reference data generated from the read data on the marked lines 410 and each of the straight lines 500K-i is calculated (step S105), as shown in FIG. 9B.

From these calculation results, the ink ejection timing adjustment values for the respective head modules 150' and a turning adjustment angle for the K inkjet head 172K are calculated (step S106).

The ink ejection timing adjustment value for each of the head modules 150' is obtained by calculating an ejection time of each head module 150' based on the reference position data by dividing the distance d-i calculated for each head module 150' by the conveyance speed of 533 mm/sec. Based on this ejection time, a value dt-i by which a delay of time from an output signal of the encoder 277 is made for each head module 150' is obtained.

These values dt-i are set as the ink ejection timing adjustment values for the respective head modules 150'-*i*. Accordingly, the head modules 150' are roughly adjusted in the conveyance Y direction.

Next, in the head modules 150' of the K inkjet head 172K, the ejection timing adjustment values dt-i are corrected for the respective head modules 150' such that a deposition position of a droplet ejected from the right-hand end nozzle 251 in the main scanning direction of one of the head modules 150' coincides with a deposition position of a droplet ejected from the left-hand end nozzle 251 of another of the head modules 150' adjacent to the right-hand side of the one of the head modules 150'.

Figure 9C:
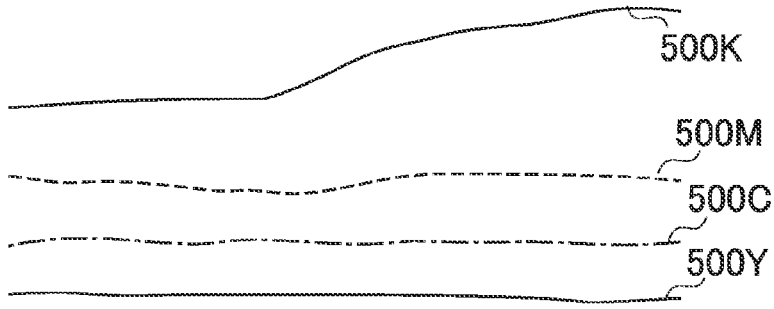
Figure 10:
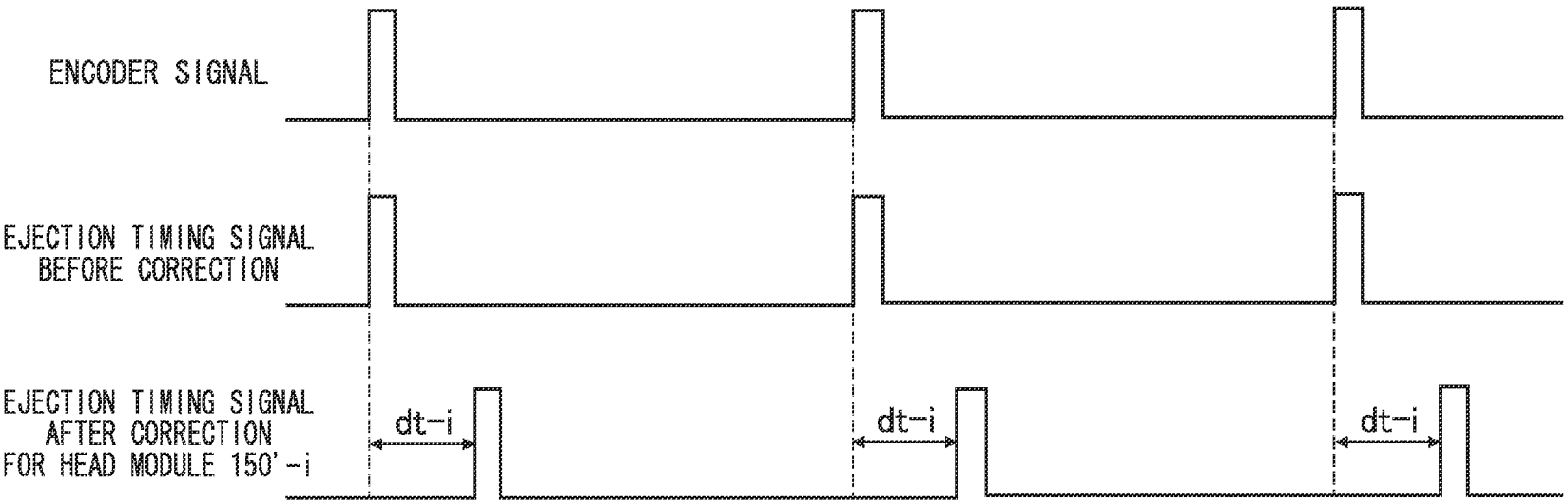
FIG. 10 is a diagram illustrating a delay of an ejection timing signal from an encoder signal for each module.

The corrected ejection timing adjustment values dt-i are reflected for the respective head modules 150' (step S107). In other words, as illustrated in FIG. 10, the head module 150'-*i* is controlled such that the ejection timing is delayed by dt-i with respect to the encoder signal. As a result, the straight lines 500K-1, 500K-2, 500K-3, . . . , 500K-n drawn by the head modules 150' become continuous along the main scanning direction as shown in FIG. 9C.

In the above description, the ejection timing adjustment values dt-i are automatically reflected for the respective head modules 150'; however, it is also possible that the ejection timing adjustment values dt-i for the head modules 150' are shown to the operator through the user interface (not shown), and the operator then performs the adjustment.

Figure 9D:
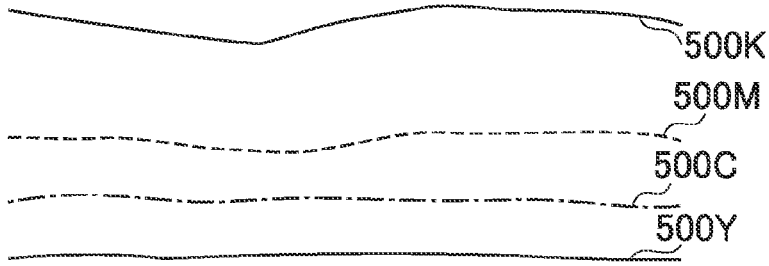

Based on the amount of displacement in the rotation direction between the continuous line 500K and the reference position data, the turning adjustment angle for the K inkjet head 172K is calculated. The turning adjustment angle is represented as a turning angle θ: if the line 500K is turned by the turning angle θ, then a fluctuation between the line 500K and the reference position data becomes the smallest. The inkjet image forming apparatus 100 shows this turning angle θ, the turning adjustment angle, to the operator through the user interface. When the operator turns the K inkjet head 172K by the turning angle θ, the K inkjet head 172K can draw a straight line perpendicular to the paper conveyance direction. FIG. 9D illustrates a state in which the line 500K shown in FIG. 9C has been turned by the desired turning angle θ.

Figure 11:
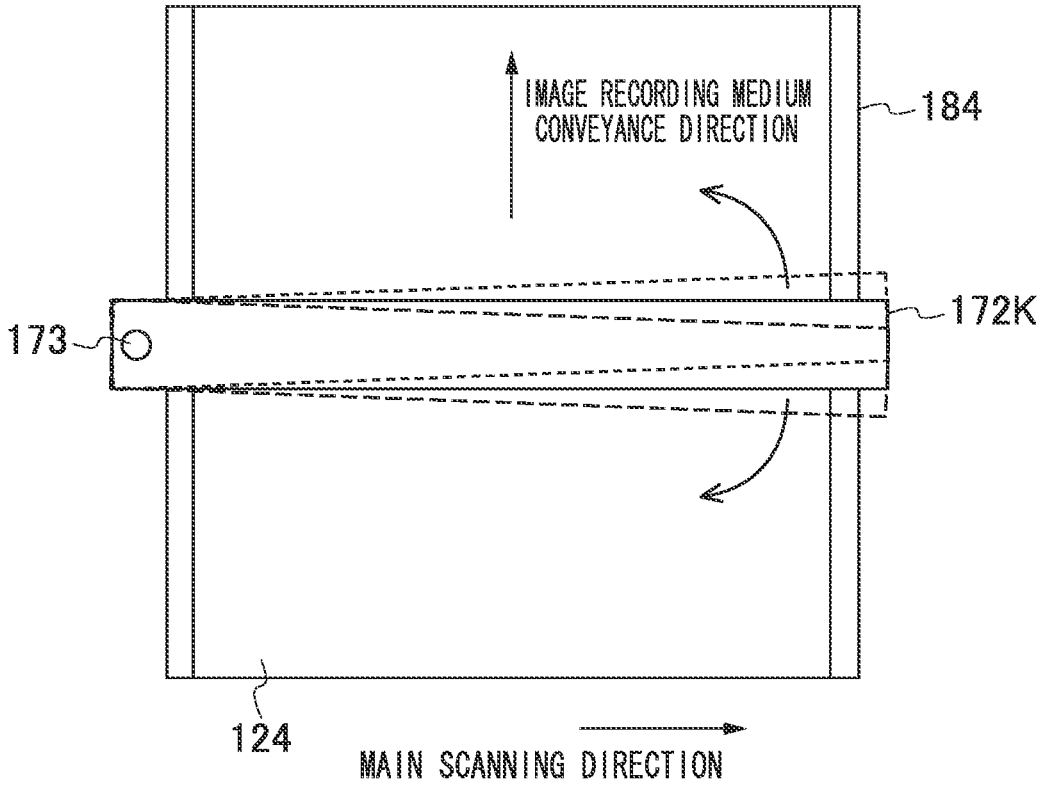
FIG. 11 is a schematic diagram illustrating how a turning adjustment with respect to a paper conveyance direction is carried out on the inkjet head.

FIG. 11 is a schematic diagram illustrating the turning adjustment with respect to the paper conveyance direction performed on the K inkjet head 172K. As shown in FIG. 11, the K inkjet head 172K is configured to be able to turn on a turning shaft 173, which is arranged at an end of the K inkjet head 172K. By allowing the K inkjet head 172K to turn on the turning shaft 173, the angle with respect to the paper conveyance direction can be adjusted. In addition, the K inkjet head 172K is provided with a mechanism (not shown) by which the operator can specify a desired angle to turn the K inkjet head 172K. The operator uses this mechanism to turn the K inkjet head 172K by the turning angle θ shown in the user interface (step S108).

Another configuration is also possible in which the K inkjet head 172K is automatically turned by the turning angle θ by using a stepping motor and the like, instead of allowing the operator to perform the adjustment.

After the adjustment of the turning angle, the inkjet heads 172 again draw, on an output sheet, respective straight lines along the main scanning direction perpendicular to the paper conveyance direction (step S109). The straight lines drawn by the inkjet heads 172 are then read by the in-line sensor 190 (step S110).

As a result of this reading, the continuity obtained by the head modules 150', the degree of parallelism between the straight lines and the position reference data, and the degree of coincidence with the lines drawn by the adjusted inkjet heads are evaluated, to determine whether the evaluation results fall within respective target ranges (step S111).

When the evaluation results fall within the respective target ranges, the adjustment is finished. When the evaluation results do not fall within the target ranges, the flow returns to step S102 to carry out the same process (step S112).

The marked lines 410 can be drawn, not on the ceramics jacket 400, but directly on the fixing drum 184 on which the ceramics jacket 400 is not arranged. Further, the marked lines 410 can be formed on, instead of the ceramics jacket 400 or the fixing drum 184, any of various belts on the paper conveyance path or components fixed to the housing of the inkjet image forming apparatus 100. The sensor for reading the marked lines 410 is not limited to the in-line sensor 190 that is also used for detecting ejection failure or for quality inspection. Any sensor can be used as long as it can read the marked lines 410 and the sheet on which the image formation is performed by the inkjet heads 172.

In the present embodiment, the adjustment is performed by delaying the ejection time for each head module 150' from the output signal of the encoder 277; however, the delaying is not the only option, and any temporal adjustment with respect to the output signal of the encoder 277 can be performed.

Second Embodiment

In the first embodiment, it has been described to replace the K inkjet head 172K only. However, adjustments can be performed by the same procedures even when attaching all of the inkjet heads 172 at the time of manufacturing or replacing two or more of the inkjet heads 172 after shipment.

Figure 12:
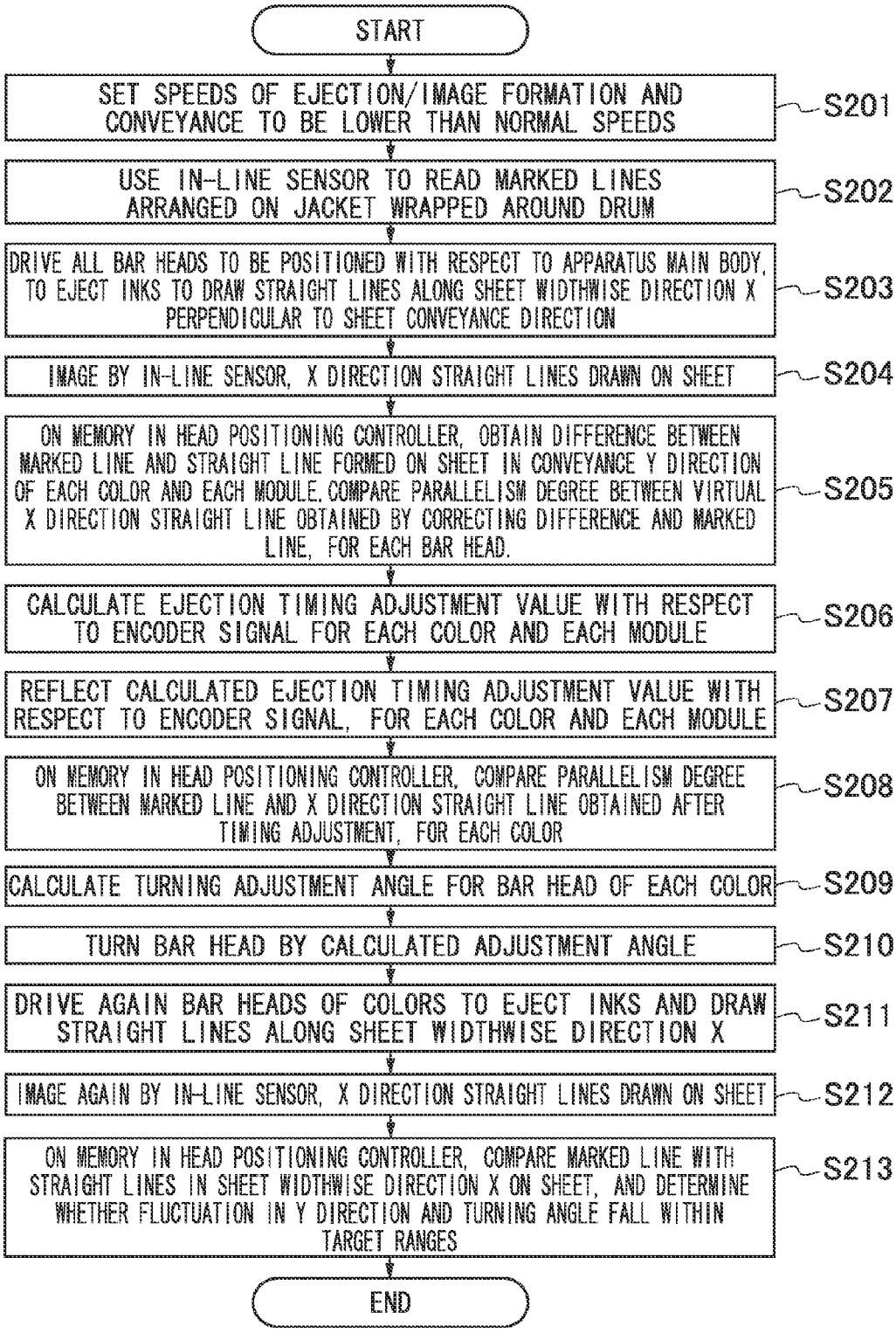
FIG. 12 is a flowchart illustrating a method of adjusting inkjet heads according to a second embodiment.

FIG. 12 is a flowchart illustrating a method of adjusting the inkjet heads according to a second embodiment.

As with the first embodiment, first, the conveyance speed is set lower than the normal speed (step S201), and the marked lines 410 that are arranged on the ceramics jacket 400 wrapped around the fixing drum 184 are read by the in-line sensor 190 (step S202). The position reference data are generated from the read data on the marked lines 410.

Next, all of the inkjet heads 172 to be adjusted are driven to eject the inks to draw straight lines along the main scanning direction on an output sheet (step S203), and these straight lines are then read by the in-line sensor 190 (step S204).

Distances dn-i between the position reference data generated from the read data on the marked lines 410 and the read straight lines drawn by the head modules in each of the inkjet heads 172 are calculated (step S205).

Based on thus obtained results, the ejection timing adjustment values for the respective head modules in each of the inkjet heads 172 are calculated (step S206), and the calculated ejection timing adjustment values are reflected (step S207). The degree of parallelism between the line drawn in the main scanning direction and the position reference data is compared for each of the colors, within the memory after the timing is adjusted (step S208), and then the turning adjustment angle for each of the inkjet heads 172 is calculated (step S209).

The operator turns the inkjet heads 172 by the respective turning adjustment angles (step S210).

The inkjet heads 172 are driven again to eject the inks to draw straight lines along the main scanning direction on an output sheet (step S211), and these straight lines are then read by the in-line sensor 190 (step S212).

As a result of this reading, it is determined whether the continuity obtained by the head modules, the degrees of parallelism between the straight lines and the position reference data, and the degree of coincidence between the respective inkjet heads 172 fall within the target ranges or not (step S213). When these elements fall within the respective target ranges, the adjustment is finished. When these elements do not fall within the target ranges, the flow returns to step S202 to perform the same processes.

As described above, the marked lines 410 used as the references for the head adjustment are arranged within the inkjet image forming apparatus 100. Therefore, all of the inkjet heads can be adjusted even when the inkjet heads are attached or replaced simultaneously, as in a case where only one head is replaced. Moreover, since the reference does not fluctuate, a highly accurate reference with no operation error caused by paper conveyance can be obtained. Although the marked lines 410 are arranged on the ceramics jacket 400, the marked lines 410 can be slightly deformed by changes in the environment such as temperature, humidity and the like; then, in order to enhance the accuracy of the reference, it is also possible to arrange marked lines on a substrate made of glass or other materials that are less affected by the environment.

As described above, unlike the method of measuring and adjusting the patterns formed on a sheet in the related art, the embodiments of the present invention can easily complete the adjustment in a short time by comparing the reference position data stored in the memory with the data stored in the memory on the straight lines that are outputted from the inkjet heads. Moreover, not only is it possible to automatically adjust the delay time with respect to the encoder signal, but also the automatic calculation of the amount of turning adjustment can assist the operator with the adjustment. As a result, a user can replace the bar heads without needing a serviceperson.

Also, whether the adjustment on the memory is completed within the optimal range or not can be confirmed, thus the number of waste sheets (sheets that are thrown away) can be reduced, and the results of the adjustment can be checked.

Regarding the accuracy of the amount of delay from the encoder signal for each head module in each of the inkjet heads, and the accuracy of the turning adjustment angle fro each of the bar heads, since the reading clock of the in-line sensor and the clock of the system (encoder pulse) are operated separately, then the imaging resolution of the in-line sensor in the conveyance direction can be freely improved by lowering the rotational speed of the drum, and consequently, the adjustment accuracy can be improved by taking the time to do so.

Moreover, even when performing the adjustment while the bar heads are not adjusted at all, the delay for each of the modules with respect to the encoder signal can be automatically generated and automatically reflected on the controller. Based on the assumption of this condition, the amount of turning adjustment can be determined. This can reduce the burden on the user.

In the foregoing description, the inkjet image forming apparatus to which the present invention is applied has been described, but the scope of application of the present invention is not limited to this. It is also possible to apply the present invention to image forming apparatuses, apart from an inkjet image forming apparatus, such as a thermal transfer recording apparatus equipped with a recording head which uses thermal elements are recording elements, an LED electrophotographic printer equipped with a recording head having LED elements as recording elements, a silver halide photographic printer having an LED line type exposure head, or the like.

The present invention can also be applied widely to inkjet systems which obtain various shapes or patterns using liquid function material, such as a wire printing apparatus, which forms an image of a wire pattern for an electronic circuit, manufacturing apparatuses for various devices, a resist printing apparatus, which uses resin liquid as a functional liquid for ejection, a color filter manufacturing apparatus, a fine structure forming apparatus for forming a fine structure using a material for material deposition, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a recording head in which a plurality of recording elements are arranged over a length corresponding to a recordable width of a recording medium;

a conveyance device which performs conveyance to cause the recording head and the recording medium to move relatively to each other one time only in a conveyance direction, a reference line being arranged on the conveyance device;

an image output device which records a prescribed image on the recording medium through the recording head;

a sensor which reads the reference line on the conveyance device, and reads the prescribed image on the recording medium recorded by the image output device; and a displacement evaluation device which evaluates a displacement between the reference line and the recording head in accordance with a result of reading the reference line by the sensor and a result of reading the prescribed image by the sensor.

2. The image recording apparatus as defined in claim 1, wherein the reference line is a straight line perpendicular to the conveyance direction.

3. The image recording apparatus as defined in claim 1, further comprising:

an angle calculation device which calculates an angle of the recording head with respect to the conveyance direction in accordance with the evaluated displacement; and a turning angle output device which outputs the calculated angle to a display device.

4. The image recording apparatus as defined in claim 3, further comprising an angle adjustment device which adjusts the angle of the recording head with respect to the conveyance direction.

5. The image recording apparatus as defined in claim 1, further comprising:

an angle calculation device which calculates an angle of the recording head with respect to the conveyance direction in accordance with the evaluated displacement;

a head turning device which turns the recording head with respect to the conveyance direction; and a control device which controls the head turning device in accordance with the calculated angle.

6. The image recording apparatus as defined in claim 1, wherein:

the recording head includes a plurality of head modules connected to each other, each of the head modules having part of the recording elements; and the image recording apparatus further comprises:

a signal acquisition device which acquires a synchronization signal synchronizing with the conveyance of the conveyance device;

a delay time calculation device which calculates a time of delay from the synchronization signal for each of the head modules in accordance with the evaluated displacement; and a delay time output device which outputs the calculated time of delay for each of the head modules, to the display device.

7. The image recording apparatus as defined in claim 6, further comprising a recording timing correction device which corrects a recording timing for each of the head modules in accordance with the calculated time of delay.

8. The image recording apparatus as defined in claim 1, wherein:

the conveyance device includes a rotary drum which conveys the recording medium; and the reference line is arranged on a thin plate wrapped around the rotary drum.

9. The image recording apparatus as defined in claim 1, wherein the sensor is configured also to inspect a recording quality of each of the recording elements.

10. The image recording apparatus as defined in claim 9, wherein:

a reading cycle of the sensor is unrelated with a conveyance speed of the conveyance device; and when the displacement evaluation device evaluates the displacement between the reference line and the recording head, the conveyance device sets the conveyance speed to be lower than the conveyance speed when the sensor inspects the recording quality of each of the recording elements.

11. A method of adjusting a recording head in an image recording apparatus including: a recording head in which a plurality of recording elements are arranged over a length corresponding to a recordable width of a recording medium, the recording head including a plurality of head modules connected to each other, each of the head modules having part of the recording elements; a conveyance device which performs conveyance to cause the recording head and the recording medium to move relatively to each other one time only in a conveyance direction, a reference line being arranged on the conveyance device; a signal acquisition device which acquires a synchronization signal synchronizing with the conveyance of the conveyance device; an image output device which records a prescribed image on the recording medium through the recording head; a sensor which reads the reference line on the conveyance device, and reads the prescribed image on the recording medium recorded by the image output device, the method comprising the steps of:

reading the reference line on the conveyance device, by using the sensor;

reading the prescribed image on the recording medium recorded by the image output device, by using the sensor;

evaluating a displacement between the reference line and the recording head in accordance with a result obtained in the step of reading the reference line and a result obtained in the step of reading the prescribed image;

calculating a time of delay from the synchronization signal for each of the head modules in accordance with the displacement evaluated in the step of evaluating; and correcting a recording timing for each of the head modules in accordance with the time of delay calculated in the step of calculating.

* * * * *